US011842878B2

(12) United States Patent
Liu et al.

(10) Patent No.: US 11,842,878 B2
(45) Date of Patent: Dec. 12, 2023

(54) INJECTION-LOCKED MAGNETRON SYSTEM BASED ON FILAMENT INJECTION

(71) Applicant: Sichuan University, Chengdu (CN)

(72) Inventors: Changjun Liu, Chengdu (CN); Shaoyue Wang, Chengdu (CN); Liping Yan, Chengdu (CN)

(73) Assignee: Sichuan University, Chengdu (CN)

( * ) Notice: Subject to any disclaimer, the term of this patent is extended or adjusted under 35 U.S.C. 154(b) by 0 days.

(21) Appl. No.: 18/079,969

(22) Filed: Dec. 13, 2022

(65) Prior Publication Data

US 2023/0187164 A1 Jun. 15, 2023

(30) Foreign Application Priority Data

Dec. 15, 2021 (CN) ..... 202111539440.0

(51) Int. Cl.
*H01J 25/50* (2006.01)
*H01J 23/38* (2006.01)

(52) U.S. Cl.
CPC ..... *H01J 25/50* (2013.01); *H01J 23/38* (2013.01)

(58) Field of Classification Search
None
See application file for complete search history.

(56) References Cited

U.S. PATENT DOCUMENTS 2,710,923 A * 6/1955 Kern ..... H03L 7/24 332/166
2,759,099 A * 8/1956 Olive ..... H01P 1/213 331/88
2,820,197 A * 1/1958 Donal, Jr. ..... H03B 9/10 332/166
3,701,020 A * 10/1972 De Vito ..... H03C 5/04 455/119
4,809,004 A * 2/1989 Brandao ..... H03L 7/02 331/88

(Continued)

FOREIGN PATENT DOCUMENTS

CN 104241064 A 12/2014

OTHER PUBLICATIONS

CNIPA, Notification of a Second Office Action for CN202111539440.0, dated Nov. 11, 2022.

(Continued)

*Primary Examiner* — Srinivas Sathiraju
(74) *Attorney, Agent, or Firm* — Zhigang Ma

(57) ABSTRACT

An injection locked magnetron system based on filament injection is provided, which includes a magnetron, an excitation cavity, and a load. The magnetron is installed on the excitation cavity and connected to the excitation cavity, the excitation cavity is detachably connected to the load, the magnetron is provided with an injection antenna, and the injection antenna is used to receive an injected external signal and couple the injected external signal into the magnetron for realizing injection locking. The injected external signal is injected by a monopole antenna, and coupled into the magnetron resonant cavity through a magnetron filament, and the output microwave of the magnetron is output through the excitation cavity, and passes through the waveguide directional coupler, and is finally absorbed by the load, such that the output microwave of the magnetron can be locked by the injected external signal.

6 Claims, 4 Drawing Sheets

(56) References Cited

U.S. PATENT DOCUMENTS 5,045,814 A * 9/1991 English ..... H01J 23/20 315/39.73
5,084,651 A * 1/1992 Farney ..... H01J 23/48 315/39.75
5,107,272 A * 4/1992 Joynson ..... G01S 7/282 331/22
5,483,123 A * 1/1996 Walker ..... H01J 23/20 315/39.75
5,598,064 A * 1/1997 Wallander ..... G05F 1/565 315/3.5
5,680,012 A * 10/1997 Walker ..... H01J 23/20 315/39.75
9,355,808 B2 * 5/2016 Huang ..... H01J 25/50
10,374,551 B2 * 8/2019 Kazakevich ..... H03B 9/10
10,426,022 B2 * 9/2019 Kazakevich ..... H01J 25/50
10,477,668 B2 * 11/2019 Chase ..... H05H 7/02
10,700,639 B2 * 6/2020 Kazakevich ..... H03B 9/10
11,474,201 B2 * 10/2022 Yang ..... G01S 7/4008
11,525,931 B2 * 12/2022 Yonehara ..... A61N 5/1075
2004/0156846 A1 * 8/2004 Daum ..... A61N 2/02 604/20
2004/0156852 A1 * 8/2004 Daum ..... A61P 9/00 604/20
2006/0187114 A1 * 8/2006 Gibson ..... G01S 7/285 342/197
2007/0139247 A1 * 6/2007 Brown ..... H04K 3/62 342/13
2015/0270091 A1 * 9/2015 Huang ..... H01J 25/50 315/39.51
2017/0094770 A1 * 3/2017 Kephart ..... H05H 7/22
2017/0250651 A1 * 8/2017 Kazakevich ..... H05H 7/02
2017/0280549 A1 * 9/2017 Chase ..... H05H 7/02
2018/0352644 A1 * 12/2018 Kephart ..... H05H 7/22
2019/0069387 A1 * 2/2019 Kazakevich ..... H05H 7/02
2019/0182910 A1 * 6/2019 Huang ..... H05B 6/68
2019/0224751 A1 * 7/2019 Thangaraj ..... H01J 37/305
2020/0015347 A1 * 1/2020 Kephart ..... H05H 7/22
2020/0044607 A1 * 2/2020 Kazakevich ..... H03B 9/10
2020/0084873 A1 * 3/2020 Kazakevich ..... H01J 25/50
2020/0116821 A1 * 4/2020 Yang ..... G01S 7/282
2020/0243294 A1 * 7/2020 Neubauer ..... H01J 23/005

OTHER PUBLICATIONS

Sichuan University (Applicant), Reply to Notification of a Second Office Action for CN202111539440.0, w/ (allowed) replacement claims, dated Nov. 15, 2022.
CNIPA, Notification to grant patent right for invention in CN202111539440.0, dated Jan. 9, 2023.

* cited by examiner

INJECTION-LOCKED MAGNETRON SYSTEM BASED ON FILAMENT INJECTION

TECHNICAL FIELD

The present disclosure relates to the technical field of controlling of magnetrons, and in particularly, to an injection-locked magnetron system based on filament injection.

DESCRIPTION OF RELATED ART

A magnetron is an important industrial microwave source. However, it has poor output characteristics, such as a wide output frequency band, and an uncontrollable phase. The magnetron injection frequency-locking technology can efficiently improve the output characteristics of a magnetron. The magnetron injection frequency-locking technology refers to injecting a high-stability low-power external signal into a low-stability high-power magnetron. When the power and frequency of the injected external signal meet a certain condition, the frequency and phase of the magnetron's output will follow the frequency and phase of the injected external signal. This technology can control the phase and frequency of a high-power oscillator through a small signal, and reduce the sideband noise of the magnetron's output. In 1947, Adler made a theoretical research on oscillator injection locking, and proposed the condition that the injected external signal should meet, that is, $\Delta f \leq 2f_0\rho/Q_{ext}$, where $\Delta f$ represents the frequency difference between the injected external signal and magnetron's output, $\rho$ represents an injection ratio, that is, a square root of a power ratio of the injected external signal to the output microwave of the magnetron, $f_0$ represents the free-running frequency of the magnetron, and $Q_{ext}$ represents an external quality factor of the magnetron. This condition is called "Adler condition".

At present, an existing technical solution is to use a waveguide circulator to isolate an injection signal source from a magnetron, and introduce the injected external signal into the output port of the magnetron through the waveguide circulator. After passing through the waveguide circulator, the injected external signal is coupled into the magnetron's resonant cavity through its output antenna, so as to achieve injection locking.

In 1989, William C. Brown proposed a prototype of an injection-locked magnetron system. The system compared the phase of reference signal and magnetron's output, and compensated the magnetron's output phase by a phase shifter to achieve accurate frequency-locking. Many additional investigations on the magnetron injection-locking technology have been conducted. In Japan, N. Shinohara et al. have studied 2.45 GHz injection-locked magnetron using the loop feedback technology, which adopted a phase-locked loop to improve performance of the magnetron by controlling its anode current. In 2005, T. Tahir et al. used a similar technology to realize an injection-locked magnetron by a digital injected signal. In 2008, Hae Jin kim et al. proposed a self-injection locking technology to improve the quality of the magnetron's output. In 2020, Xiaojie Chen proposed a novel magnetron injection locking and power combining system, which replaced a waveguide circulator with a magic-Tee. The magic-Tee can simultaneously realize the injection locking and power combining of two magnetrons, and reduce the loss caused by the waveguide circulators.

In the existing injection locking technology, a large-volume waveguide isolator is required to isolate external signal sources from magnetrons' output, such as a waveguide circulator or a magic-Tee. The volume and weight of waveguide isolators are very large and its manufacturing cost is high, which makes the whole injection locking system huge and expensive. Furthermore, the introduction of the waveguide circulator or the magic-Tee can also increase the loss of the whole system.

SUMMARY

In view of this, the purpose of the present disclosure is to provide a novel injection-locked magnetron system based on filament injection to solve the problems of large occupied space, high manufacturing cost and high insertion loss in the related technology, which caused by the large-volume waveguide isolator for isolating external signal sources from magnetrons' output.

The present disclosure is implemented through the following technical solutions.

An embodiment of the present disclosure provides a novel injection-locked magnetron system based on filament injection, which includes: a magnetron, an excitation cavity, and a load; where the magnetron is installed on the excitation cavity and connected to the excitation cavity, the excitation cavity is detachably connected to the load, the magnetron is provided with an injection antenna, and the injection antenna is used to receive an injected external signal and couple the injected external signal into the magnetron to realize injection locking of the magnetron.

In an embodiment of the present disclosure, the magnetron includes a magnetron filament, a magnetron filament cavity, a magnetron resonant cavity, and a magnetron power supply terminal; the magnetron power supply terminal and a part of the injection antenna are installed outside the magnetron filament cavity.

In an embodiment of the present disclosure, the magnetron filament cavity is provided with a through hole through which the injection antenna penetrates, the injection antenna is used to extend into the magnetron filament cavity through the through hole, and the magnetron filament is installed in the magnetron resonant cavity.

In an embodiment of the present disclosure, the injection antenna is connected to a coaxial transmission line.

In an embodiment of the present disclosure, an input voltage of the magnetron power supply terminal is a direct current (DC) voltage of 4000 volts (V).

In an embodiment of the present disclosure, the excitation cavity and the load are fixedly connected by flanges, and the magnetron is integrally connected to the excitation cavity by bolts.

In an embodiment of the present disclosure, the injection antenna includes at least one of a monopole antenna, a dipole antenna, and a loop antenna.

In summary, due to the above technical solutions, the present disclosure has at least the following beneficial effects.

1. In the present disclosure, the injected external signal is injected by the monopole antenna, and coupled into the magnetron resonant cavity through the magnetron filament, and the output microwave of the magnetron is output through the excitation cavity, and passes through the waveguide directional coupler, and is finally absorbed by the load, such that the output microwave of the magnetron can be locked by the injected external signal, and the frequency of the output microwave of the magnetron completely follows the frequency of the injected external signal within a locking bandwidth.
2. With the technical solution of the present disclosure, the number of waveguide isolators in the system can be reduced, for example, two high-power three-port circulators, one load and one waveguide-coaxial converter are removed, thereby greatly reducing the occupied space and the overall cost.

Figure 1:
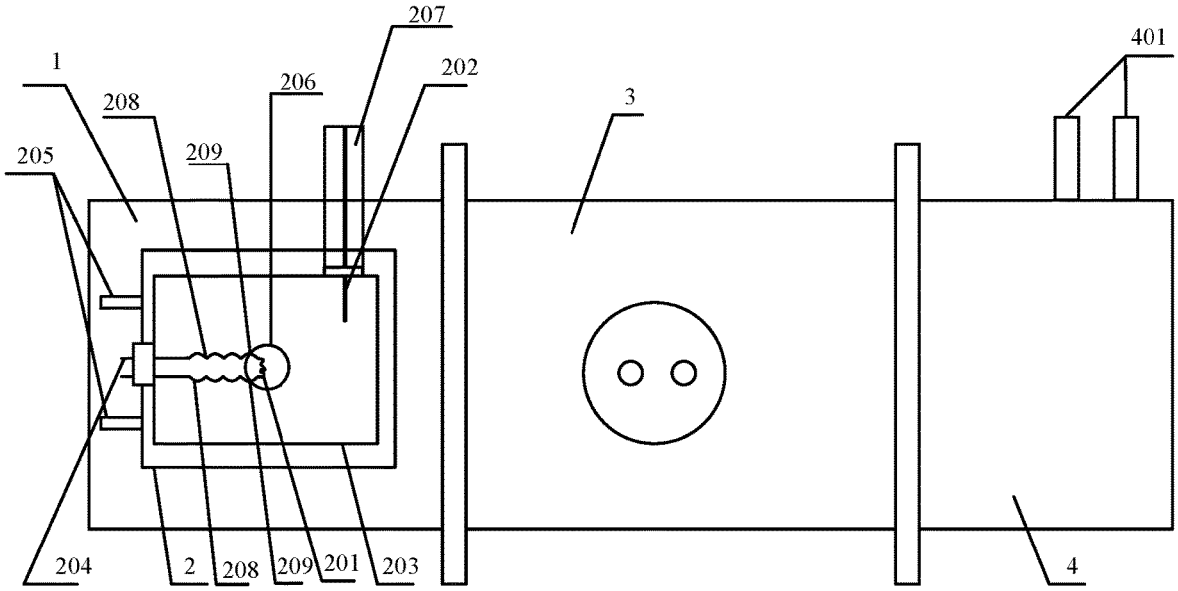
FIG. 1 illustrates a top view of an injection-locked magnetron system based on filament injection according to an embodiment of the present disclosure.

Reference numerals: 1. Excitation cavity; 2. Magnetron; 3. Waveguide directional coupler; 4. Load; 201. Magnetron filament; 202. Monopole antenna; 203. Magnetron filament cavity; 204. Magnetron power supply terminal; 205. First cold water supply terminal; 206. Magnetron resonant cavity; 207. Coaxial transmission line; 208. Inductance coil; 209. Lead; 401. Second cold water supply terminal.

DETAILED DESCRIPTION OF EMBODIMENTS

All features disclosed in this specification, or steps in all methods or processes disclosed, except mutually exclusive features and/or steps thereof, can be combined in any way.

Unless otherwise stated, any of the all features disclosed in this specification (including any additional claims and abstract) can be replaced by other equivalent features or alternative features with similar purpose. That is to say, unless otherwise stated, each of the all feature is merely one example in a series of equivalent or similar features.

In the description of the present disclosure, it should be understood that orientations or positional relationships indicated by terms "up", "down", "left" and "right" are based on the orientations or positional relationships shown in the accompanying drawings, merely for convenience and simplification of the description of the present disclosure, and do not indicate or imply that the referred equipment or elements must have a specific orientation, be constructed and operated in a specific orientation, and therefore cannot be understood as a limitation of the present disclosure.

In addition, terms "first" and "second" are merely used for descriptive purposes, and cannot be understood as indicating or implying relative importance or implicitly indicating the number of indicated technical features. Thus, a feature defined with the term "first", "second", or the like may explicitly or implicitly include one or more of the feature.

Figure 2:
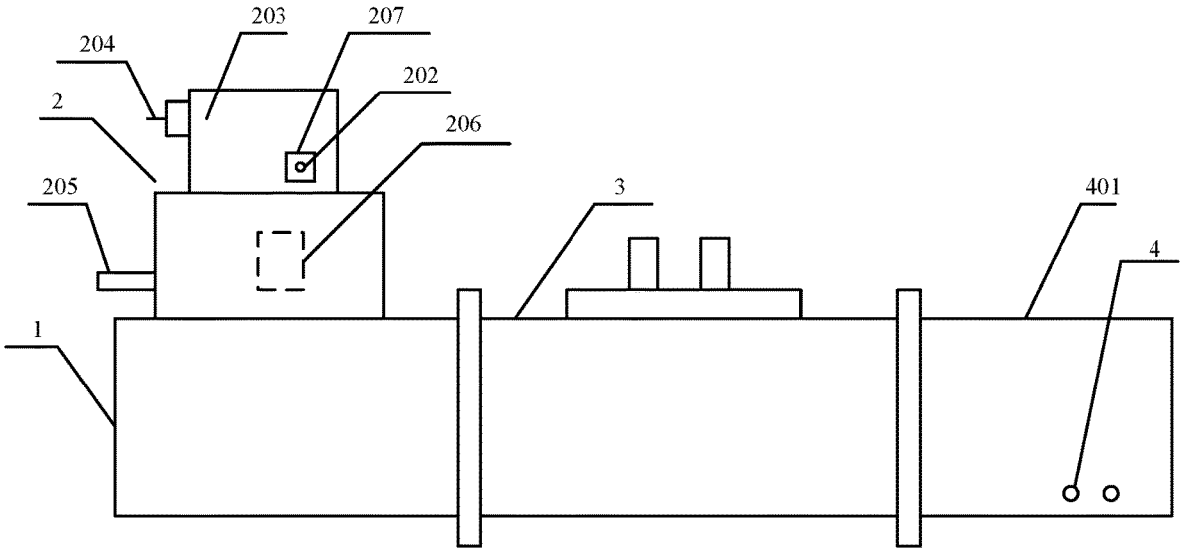
FIG. 2 illustrates a side view of an injection-locked magnetron system based on filament injection according to an embodiment of the present disclosure.

As shown in FIGS. 1 and 2, a novel injection-locked magnetron system based on filament injection is provided, which includes an excitation cavity 1, a magnetron 2, a waveguide directional coupler 3 and a load 4. The magnetron 2 is installed on the excitation cavity 1 and connected to the excitation cavity 1. The waveguide directional coupler 3 is detachably connected to the excitation cavity 1. The waveguide directional coupler 3 is directionally detachably connected to the load 4. The magnetron 2 is provided with an injection antenna 202, and the injection antenna 202 is used to receive an injected external signal and couple the injected external signal into the magnetron 2 to realize injection locking of the magnetron 2.

In an embodiment of the present disclosure, the magnetron 2 includes a magnetron filament 201, a magnetron filament cavity 203, a magnetron resonant cavity 206, a magnetron power supply terminal 204, and a first cold water supply terminal 205. The injection antenna 202 is a monopole antenna. The magnetron power supply terminal 204 and a part of the monopole antenna 202 are installed outside the magnetron filament cavity 203.

In an embodiment of the present disclosure, the first cold water supply terminal 205 is installed outside the magnetron resonant cavity 206, and the magnetron power supply terminal 204 and the first cold water supply terminal 205 are respectively installed on same directional side walls of the magnetron filament cavity 203 and the magnetron resonant cavity 206.

In an embodiment of the present disclosure, the magnetron filament cavity 203 is provided with a through hole through which the monopole antenna 202 penetrates, the monopole antenna 202 is used to extend into the magnetron filament cavity 203 through the through hole, and the magnetron filament 201 is installed in the magnetron resonant cavity 206.

In an embodiment of the present disclosure, a cooling assembly is installed outside the magnetron resonant cavity 206. The cooling assembly is installed to surround the magnetron resonant cavity 206. A cooling medium is supplied through the first cold water supply terminal 205 and the cooling assembly to cool the magnetron resonant cavity 206.

In other embodiments of the present disclosure, the cooling assembly is used for cooling the magnetron resonant cavity 206 through a cooling medium, which may be air or other liquids.

In an embodiment of the present disclosure, the monopole antenna 202 is connected to a coaxial transmission line.

In an embodiment of the present disclosure, the load 4 is provided with a second cold water supply terminal 401.

Based on the above structure, the excitation cavity 1 is used to excite the fundamental mode of output energy, and the waveguide directional coupler 3 is used to output spectrum of the magnetron 2. A direct current (DC) voltage of 4000 voltages (V) is input to the magnetron filament cavity 203 through the magnetron power supply terminal 204. Further, in order to prevent the leakage of an RF signal of the magnetron 2, two inductance coils 208 are installed in the magnetron filament cavity 203 and outside the magnetron resonant cavity 206, so components installed in the magnetron filament cavity 203 can be used as a coupling antenna to couple the injected external signal into the magnetron resonant cavity 206, thereby realizing injection locking. Specifically, the two inductance coils 208 are in one-to-one correspondence connected to two leads 209 of the magnetron filament 201, and the two leads 209 of the magnetron filament 201 are positioned in the magnetron filament cavity 203. Therefore, in the technical solution of the present disclosure, the injected external signal is injected by the monopole antenna 202, and coupled into the magnetron resonant cavity 203 through the magnetron filament 201, and the output microwave of the magnetron 2 is output through the excitation cavity 1, and passes through the waveguide directional coupler 3, and is finally absorbed by the load 4, such that the output microwave of the magnetron 2 can be locked by the injected external signal, and the frequency of the output microwave of the magnetron 2 completely follows the frequency of the injected external signal within a locking bandwidth.

In the traditional magnetron injection frequency-locking technology, an injected external signal is injected by a waveguide isolator and then is coupled through the excitation cavity 1 for realizing injection locking. In contrast, in the present disclosure, the monopole antenna 202 is used to extend into the magnetron filament cavity 203 by the through hole drilled in the magnetron filament cavity 203, for realizing injection locking.

The excitation cavity 1, the waveguide directional coupler 4 and the load 4 are fixedly connected to each other by flanges, and the magnetron 2 is in whole connected to the excitation cavity 1 by bolts.

Further, it should be noted that, the injection antenna 202 may also be a dipole antenna or a loop antenna. Moreover, the injection antenna 202 may be more than one in number, and the multiple injection antenna 202 may be at least two of the monopole antennas, the dipole antennas, and the loop antennas.

With respect to the technical solution of the present disclosure, the inventor performed a verification experiment, and filament injection locking of the magnetron 2 is achieved without introducing a waveguide circulator. A final injection locking performance is shown in table 1 below.

TABLE 1

| Injection locking performance | |
|---|---|
| Injection ratio | Locking bandwidth |
| −15 dB | 0.7 MHz |
| −20 dB | 0.3 MHz |
| −22 dB | 0.15 MHz |
| −25 dB | 0.1 MHz |
| −30 dB | 0.05 MHz |
| −34 dB | 0.02 MHz |
| −39 dB | less than 0.01 MHz |

Figure 3:
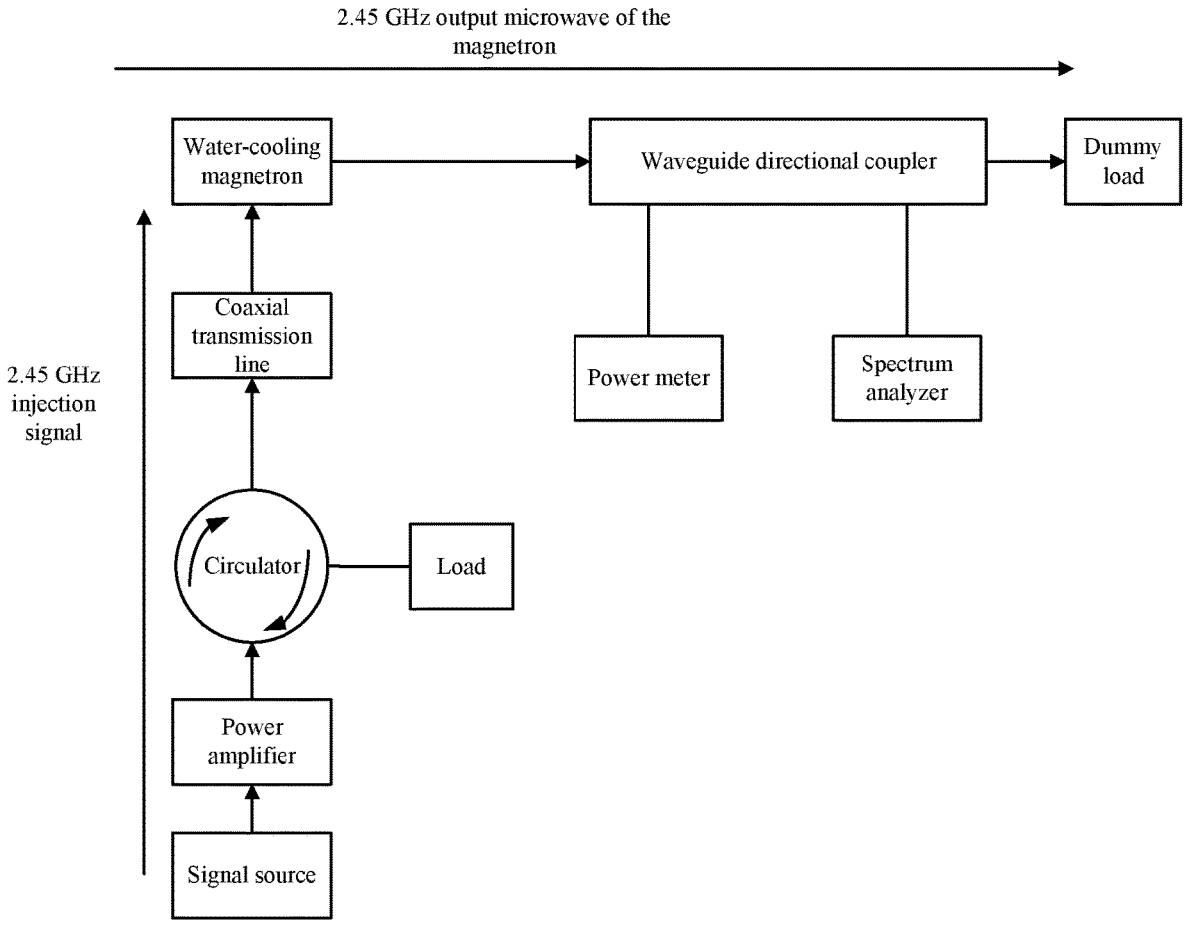
FIG. 3 illustrates a block diagram of an injection locking test according to an embodiment of the present disclosure.

A test block view of the present disclosure is shown in FIG. 3. The magnetron 2 is connected to the excitation cavity 1, and the fundamental mode of output energy is excited through the excitation cavity 1. The waveguide directional coupler 3 is used to detect the output spectrum of the magnetron 2. The injection locked magnetron system based on filament injection uses the load 4 to absorb the microwave energy. The monopole antenna 202 is connected to a coaxial transmission line 207 and is installed to extend into the magnetron filament cavity 203. The excitation cavity 1, the waveguide directional coupler 3 and the load 4 are fixedly connected through flanges. The magnetron 2 is fixed to the waveguide cavity 1 by screws. Signal flow directions are shown by arrows in the FIG. 3.

Figure 4:
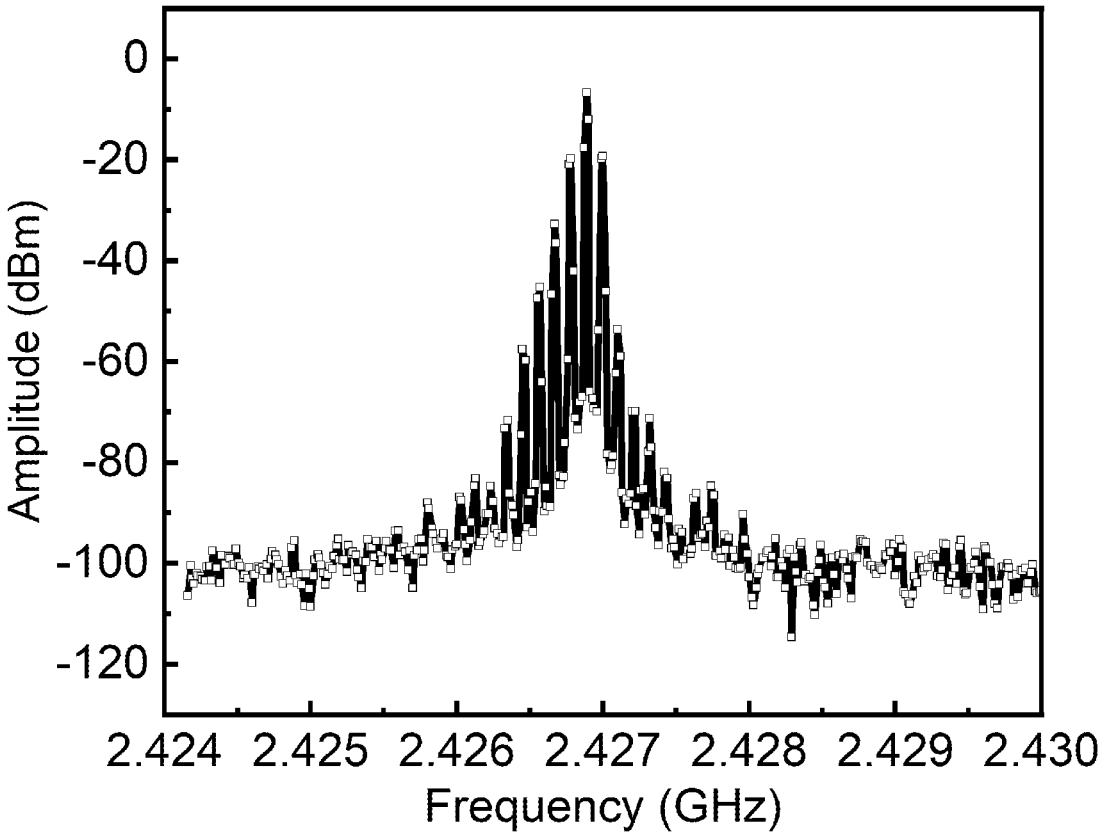
FIG. 4 illustrates a periodic pulling spectrum view before performing injection locking.
Figure 5:
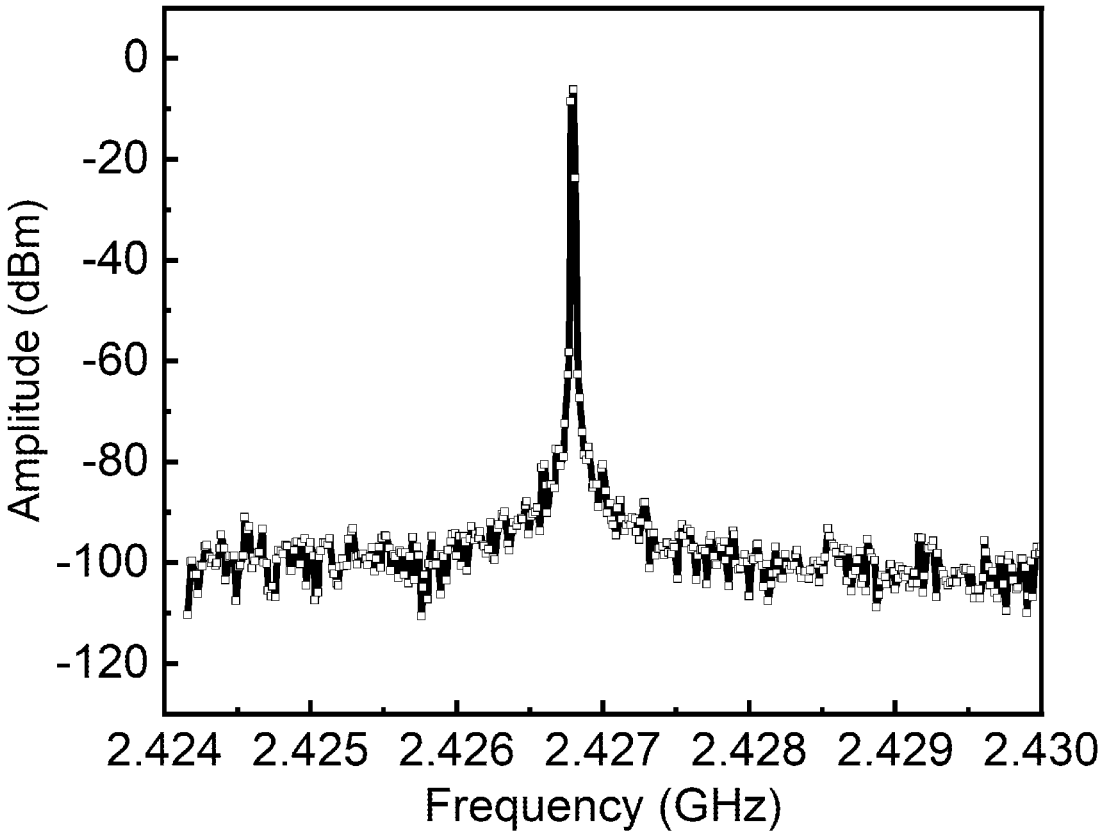
FIG. 5 illustrates an injection-locking spectrum view after performing injection locking.

In this test experiment, an injected external signal is provided by a signal source and a high-gain power amplifier. It can be clearly observed by a spectrum analyzer that an output microwave of the magnetron 2 is locked by the injected external signal. With the increase of the power of the injected external signal and the change of the frequency, it can be observed that the periodic pulling spectrum before performing injection locking and the injection locking spectrum after performing injection locking are shown in FIG. 4 and FIG. 5, respectively.

The finally measured locking bandwidths at different injection ratios are shown in the table 1 above. The measured results show that the proposed system of the present disclosure is feasible.

The reasons for the narrow locking bandwidth are: 1) the monopole antenna 202 is not well matched; 2) there is a certain transmission loss between the magnetron filament cavity 203 and the magnetron resonant cavity 206, and the signal from the magnetron filament cavity 203 is not completely coupled into the magnetron resonant cavity 206. In the future, after the monopole antenna 202 is completely matched with the magnetron filament 201, it is expected that the locking bandwidth of the present disclosure comparable to that of the traditional solution can be achieved with low system cost and a smaller volume.

The above is merely preferred embodiments of the present disclosure, and are not intended to limit the present disclosure. Any modification, equivalent substitution and improvement made within the spirit and principle of the present disclosure should be included in the scope of protection of the present disclosure.

What is claimed is:

1. An injection-locked magnetron system based on filament injection, comprising a magnetron, an injection antenna, an excitation cavity, and a load; wherein the magnetron is installed on the excitation cavity and connected to the excitation cavity, the excitation cavity is detachably connected to the load, the magnetron is provided with an antenna for external communication, and the antenna for external communication is configured to couple an injected external signal into the magnetron for realizing injection locking; the magnetron comprises a magnetron filament, a magnetron filament cavity, the injection antenna, a magnetron resonant cavity, and a magnetron power supply terminal; the magnetron power supply terminal and the injection antenna are installed outside the magnetron filament cavity; the magnetron filament cavity is provided with a through hole through which the injection antenna penetrates, the injection antenna is configured to extend into the magnetron filament cavity through the through hole, and a feed terminal of the magnetron filament is arranged in the magnetron filament cavity; and an output microwave of the magnetron is output through the excitation cavity, and passes through a waveguide directional coupler, and is finally absorbed by the load.

2. The injection-locked magnetron system based on filament injection according to claim 1, wherein the injection antenna is connected to a coaxial transmission line.

3. The injection-locked magnetron system based on filament injection according to claim 2, wherein an input voltage of the magnetron power supply terminal is a direct current (DC) voltage of 4000 volts (V).

4. The injection-locked magnetron system based on filament injection according to claim 3, wherein the excitation cavity and the load are fixedly connected by flanges, and the magnetron is connected to the excitation cavity by bolts.

5. The injection-locked magnetron system based on filament injection according to claim 1, wherein the injection antenna comprises at least one of a monopole antenna, a dipole antenna, and a loop antenna.

6. The injection-locked magnetron system based on filament injection according to claim 1, wherein the waveguide directional coupler is detachably connected to the excitation cavity and is directionally detachably connected to the load.

* * * * *